United States Patent [19]

Larson

[11] Patent Number: 4,686,955

[45] Date of Patent: Aug. 18, 1987

[54] COMPOUND ARCHERY BOWS

[75] Inventor: Marlow W. Larson, Ogden, Utah

[73] Assignee: Browning Arms Company, Morgan, Utah

[21] Appl. No.: 676,740

[22] Filed: Nov. 29, 1984

Related U.S. Application Data

[63] Continuation-in-part of Ser. No. 236,781, Feb. 23, 1981.

[51] Int. Cl.[4] ..... F41B 5/00

[52] U.S. Cl. ..... 124/23 R; 124/DIG. 1

[58] Field of Search ..... 124/23 R, 24 R, 86, 124/DIG. 1, 90

[56] References Cited

U.S. PATENT DOCUMENTS

| | | | |
|---|---|---|---|
| 3,486,495 | 12/1969 | Allen | 124/24 R |
| 3,923,035 | 12/1975 | Trotter | 124/86 |
| 4,338,910 | 7/1982 | Darlington | 124/24 R |
| 4,340,025 | 7/1982 | Caldwell | 124/23 R |
| 4,512,326 | 4/1985 | Jarrett | 124/23 R |
| 4,519,374 | 5/1985 | Miller | 124/23 R |

OTHER PUBLICATIONS

Bow & Arrow, Feb. 1983, pp. 28–30, 58, 60, 61.

*Primary Examiner*—Richard C. Pinkham
*Assistant Examiner*—Benjamin Layno
*Attorney, Agent, or Firm*—Trask, Britt & Rossa

[57] ABSTRACT

An eccentric for a compound bow includes two sheaves for the bowstring and tension runs, respectively. The sheaves carry nonparallel tracks of noncircular configuration which are oriented so that the cam ratio of the eccentric increases rapidly during the initial stages of draw. The track for the tension run includes a ramp which urges the terminal end of the tension run down towards the axis of the eccentric and away from the plane of the bowstring.

11 Claims, 14 Drawing Figures

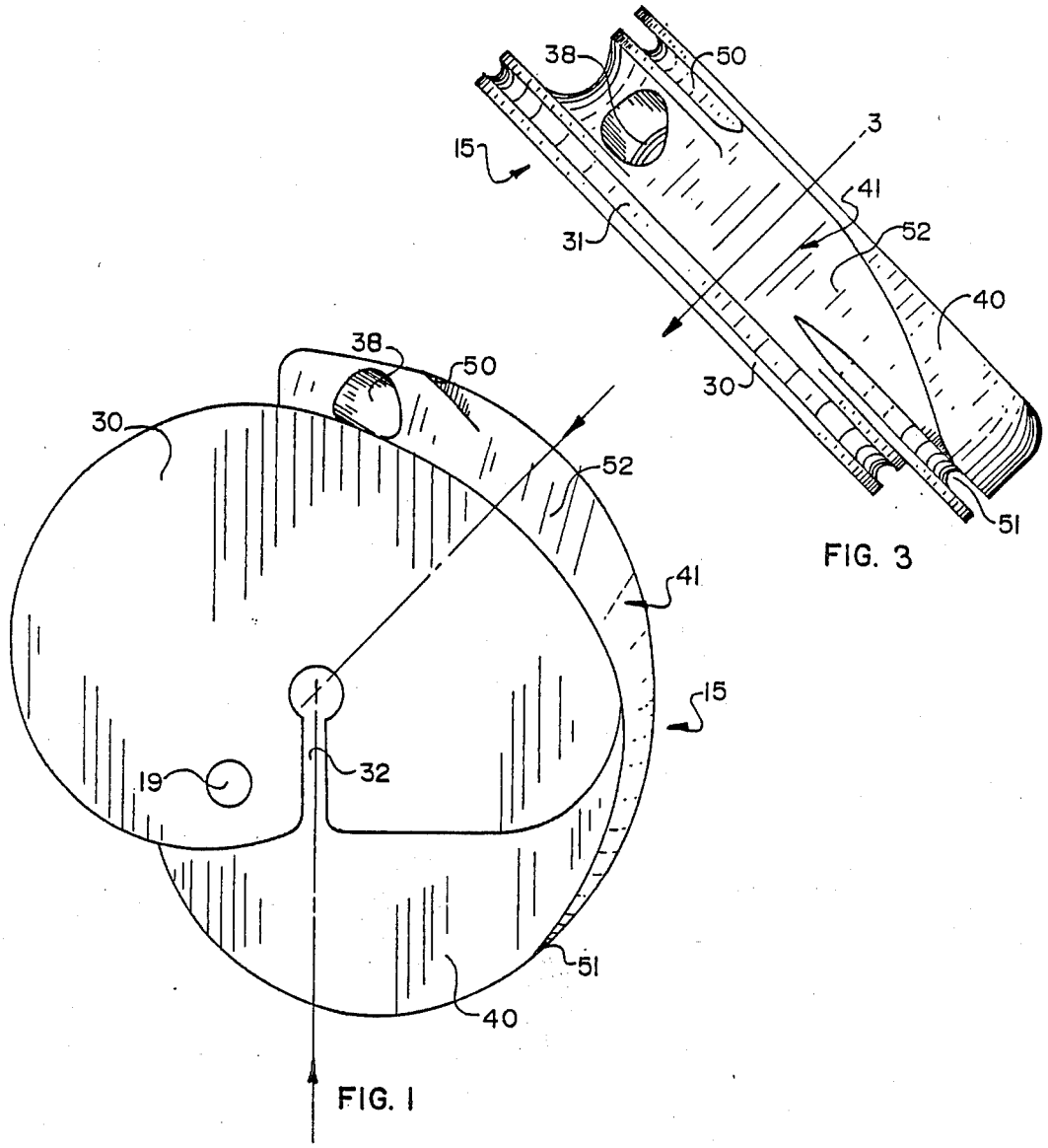
FIG. 3
FIG. 1
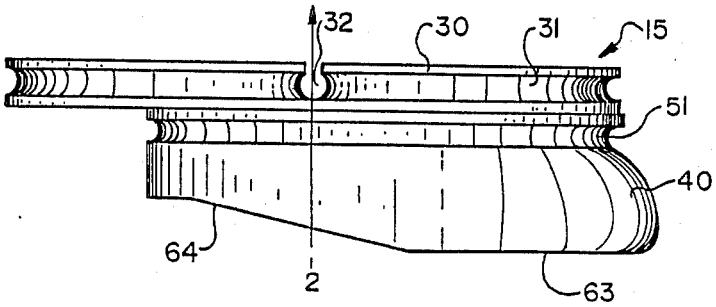
FIG. 2

COMPOUND ARCHERY BOWS

RELATED APPLICATIONS

This application is a continuation-in-part of commonly assigned Ser. No. 236,781 filed Feb. 23, 1981, the disclosure of which is incorporated by reference herein.

The parent application is directed to an improved eccentric which combines the advantages of "side-by-side" and "step-down" eccentrics. The present invention is directed to a further improved eccentric which incorporates the advantages of the eccentric disclosed by the parent application.

BACKGROUND OF THE INVENTION

1. Field

This invention pertains to compound archery bows and is more particularly directed to the eccentric members associated with the flexible limbs of such bows.

2. State of the Art

Archery bows of the type commonly known as "compound bows" are generally characterized by a pair of flexible limbs extending from opposite ends of a handle. The tips of the limbs are thus spaced apart in relationship to each other in a fashion similar to the limb tips of a traditional stick bow. The limbs are deflected by the operation of a bowstring in the same fashion as a traditional bow, but the bowstring is interconnected to the limbs through a rigging system including mechanical advantage-varying structures (including those commonly referred to as "eccentrics") and tension runs which transfer a multiple of the bowstring tension to the respective limbs. Tension runs are interchangeably and loosely referred to by those skilled in the art as "cables," "cable stretches," "bow string end stretches" and "end stretches." In any event, the rigging system may be regarded as a specialized block and tackle arrangement whereby pulling force applied to the bowstring is transferred to the limb tips to flex the limbs. The bowstring and tension runs may comprise a single continuous loop, but more typically, the bowstring is constructed of special bowstring material, while the tension runs are of more rugged construction, e.g. as from aircraft cable. The bowstring and tension runs together are referred to interchangeably as the "cable system," "cable loop" or "rigging loop."

The rigging of a compound bow functions as a block and tackle to provide a mechanical advantage between the force applied to the bowstring by an archer and the force applied to the bow limbs. In other words, in operation, the nocking point of the bowstring is moved a longer distance than the total distance that the two limb tips move from their braced position. Although other configurations are possible, an eccentric is usually pivotally mounted at each limb tip. If the eccentrics are mounted elsewhere, the rigging usually includes a concentric pulley at each limb tip.

Each eccentric has grooves or tracks analagous to the pulley grooves in a traditional block. A string track is arranged alternately to pay out or take up string as the limbs are alternately flexed to drawn or relaxed to braced condition. A cable track is arranged alternately to take up portions of the tension run as string is paid out while the eccentric pivots to drawn condition and to pay out portions of the tension run as string is wound onto the string track while the eccentric pivots to braced condition.

For purposes of this disclosure, it is recognized that in the operation of a compound bow, the portion of the rigging called the bowstring actually lengthens as the string is pulled back because as the eccentrics pivot from their braced condition, portions of the bowstring stored in the string tracks unwind and are paid out. Concurrently, portions of the tension run are wound onto the cable tracks of the eccentrics so that the tension runs decrease in length. The opposite phenomenon occurs as the string is released, permitting the eccentrics to pivot back to their braced condition. Assuming that the eccentrics are carried by the respective limbtips, the portion of the rigging loop extending between points of tangency of the bowstring with the string track of the eccentrics will be referred to herein as the "central stretch" of the bowstring. The bowstring shall be considered to include, in addition to the central stretch, portions of the rigging loop stored at any time in association with the string tracks of the eccentrics. The portions of the rigging loop extending from the points of tangency of the tension stretches with the cable tracks of the eccentrics to remote points of attachment to the bow shall be called the "end stretches." Each tension run is considered to include, in addition to an end stretch, the portion of the rigging loop extending from the end stretch and wrapped within or otherwise stored in association with the cable track of the associated eccentric.

BRIEF DESCRIPTION OF THE DRAWINGS

In the drawings, which illustrate that which is presently regarded as the best mode for carrying out the invention:

FIG. 1 is a view in elevation of an eccentric member constructed in accordance with this invention;

FIG. 2 is a view of the eccentric member of FIG. 1 from the vantage point of the reference line 2; that is, with the bottom rotated up 90° around a horizontal axis congruent with the plane of the paper;

FIG. 3 is a view of the eccentric member of FIG. 1 from the vantage point of the reference line 3; that is, rotated slightly around an axis normal the paper to the position indicated by reference line 3 and with the top then rotated down 90° with respect to a horizontal axis congruent with the plane of the paper;

Figure 12:
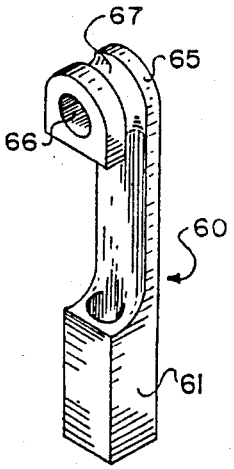
Figure 13:
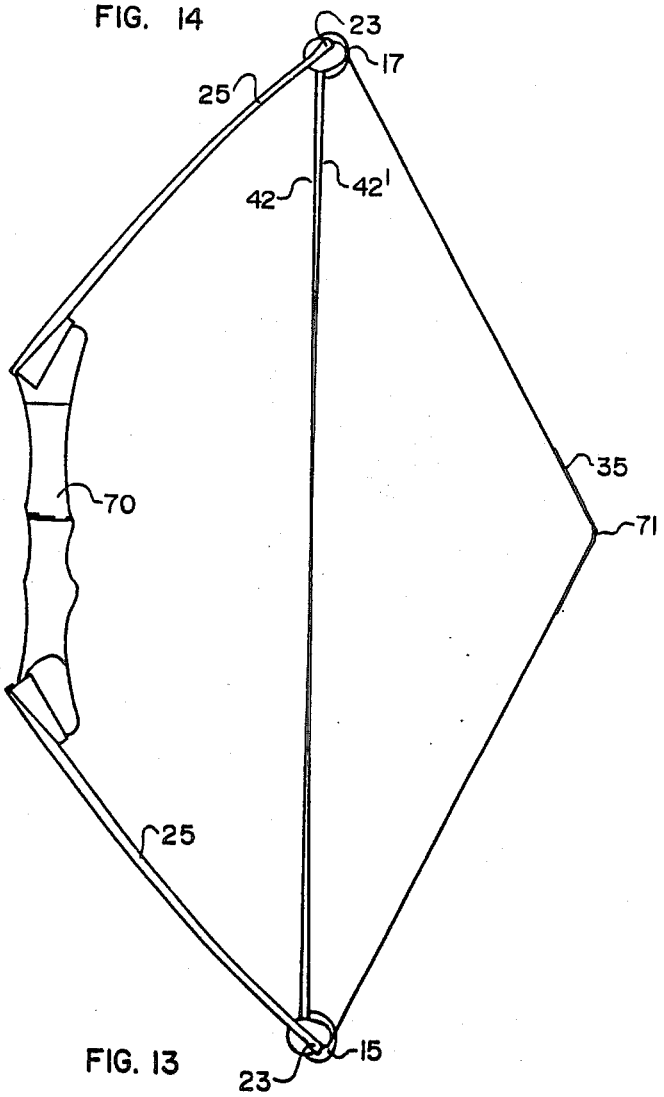

that is, with the bow limb rotated 180° with respect to a vertical axis;

FIG. 12 is a perspective view of a cable shifter mounted in association with the eccentric;

FIG. 13 is a schematic view of an assembled compound bow; and

Figure 14:
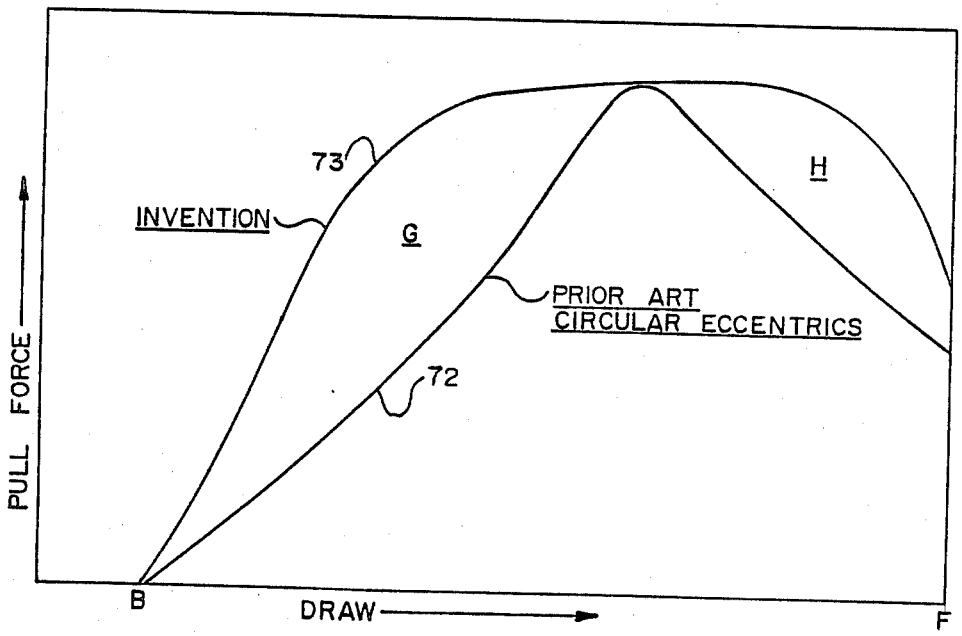

FIG. 14 is a sketch of theoretical force-draw curves representative of the prior art and this invention, respectively.

SUMMARY OF THE INVENTION

The present invention provides an improved eccentric element for the rigging system of "compound bows." The eccentrics of this invention may be used in place of more conventional eccentrics in any of the various configurations of compound bows heretofore known in the archery art. The principals of operation of this invention may be understood and are conveniently described with reference to a bow in which a pair of resilient limbs are deflected by the operation of a bowstring interconnected to the distal ends (or tips) of the limbs through a three-line lacing (rigging) including an eccentric of this invention pivotally mounted at each limb tip. The eccentrics may be referred to as the "upper eccentric" and "lower eccentric," respectively, having reference to their relative positioning when the handle of the bow is grasped by the archer in a normal shooting position. (That is, with the limbs held approximately vertically.) According to this invention, the upper eccentric may be a reverse ("mirror image") of the lower eccentric.

Each eccentric includes two sheave portions. The first such portion accommodates one end of the bowstring or central stretch in a bowstring-engaging track which is usually of non-circular configuration. The second portion accommodates a tension run or end stretch in a tension-engaging track which is usually also of non-circular configuration. The first and second tracks are arranged with respect to each other to effect a varying "cam ratio" between the points of tangency of the central stretch and the end stretch with the eccentric. That is, the distance between the axis of the eccentric and the respective points of tangency vary as the eccentric pivots on its axis in response to pulling of the bowstring. The cam ratio of the eccentric may be defined as the ratio of the perpendicular distance between the axis of the eccentric and the point of tangency of the bowstring divided by the perpendicular distance between said axis and the point of tangency of the end stretch. The larger the cam ratio, the greater the mechanical advantage effected through the eccentric.

The step-down take-up cable ramp described in the aforesaid parent application Ser. No. 236,781 is incorporated in the eccentric of the present invention. This ramp functions to move the portion of the tension run adjacent the cable track down towards the axis of the eccentric and laterally towards the string track of the eccentric as the eccentric pivots toward its drawn condition. As the eccentrics are permitted to pivot back towards braced condition (the drawn bowstring is released), this portion of the tension run is carried laterally away from the string, thereby to afford vane clearance for a launched arrow. In addition, the opposite end of the tension run; that is, the termination of the end stretch extending from a point of tangency with the cable track of the opposite eccentric, is moved out laterally away from the string track in braced condition and laterally toward the string track in drawn condition by means of a cable shifter. The cable shifter is generally associated with the eccentric to move the tension run in and out in response to the pivoted position of the eccentric.

A principal advantage of the shifter is that it permits attachment of the terminations of the tension stretch close to the center of the axle (defined by a plane normal to and intersecting the axis of the axle at the midline of the limb). It also serves to maintain tension on the tension run as the eccentrics move to braced condition, thereby avoiding much of the noise characteristic of compound bows.

Because of the expedients for providing vane clearance, the eccentrics of this invention are relatively narrow. This narrowness assists in concentrating the forces applied by the rigging near the midline of the bow limbs, contributing to the stability of the system. In some embodiments, further noise supression and stability are provided by the interaction of a resilient bumper with the shifter to provide a noise-free positive stop.

The runs of the rigging may be anchored to the eccentrics by means of a single screw pressing on a run through the center of the eccentrics. This system provides for infinite adjustment (betwen finite limits; e.g., 28 to 30 inches) of draw length.

The shape of the force-draw curves which can be developed through the use of the eccentrics of this invention offer several advantages. The initial slope of the force-draw curve can be made very steep, and the let-off of pulling force characteristic of compound bows generally can be caused to occur very near full draw. Accordingly, substantially more available energy may be stored in the limbs of the bow with the eccentrics of this invention as compared to eccentrics of the prior art.

DESCRIPTION OF THE ILLUSTRATED EMBODIMENT

The embodiment illustrated by the drawings includes a lower eccentric 15 (FIGS. 1 through 7 and 13) and an upper eccentric 17 (FIGS. 8 through 12). These eccentrics are substantially similar except that they are reversed in configuration. Each eccentric 15, 17 is provided with a pivot hole 19 which accommodates an axle 21 (FIGS. 8 and 9) by which it is pivotally mounted to the distal end 23 of a limb 25.

Figure 7:
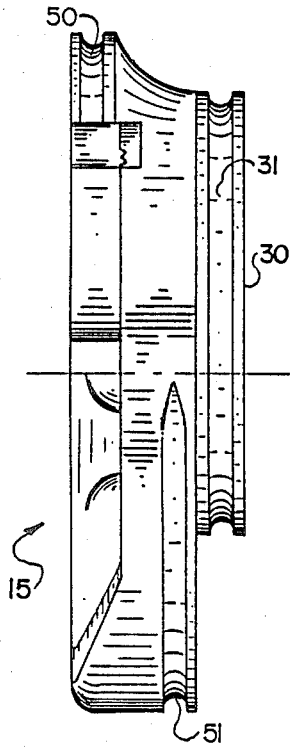
FIG. 7 is a view of the eccentric member of FIG. 4 from the line of sight indicated by the reference line 7—7 of FIG. 4.
Figure 5:
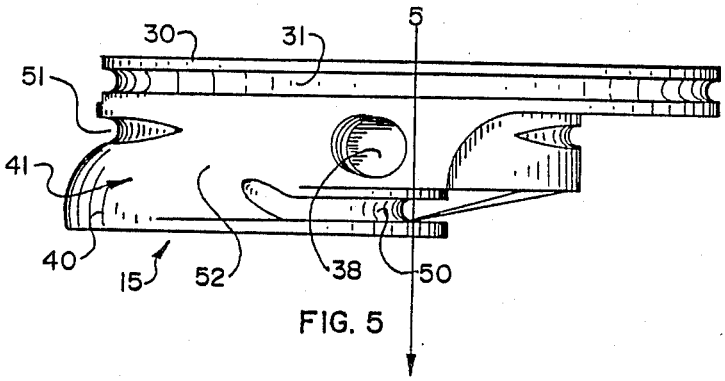
FIGS. 5 and 6 are views from the top and bottom, respectively, of the eccentric member as shown by FIG. 4 from the vantage points indicated by reference lines 5 and 6, respectively.
Figure 4:
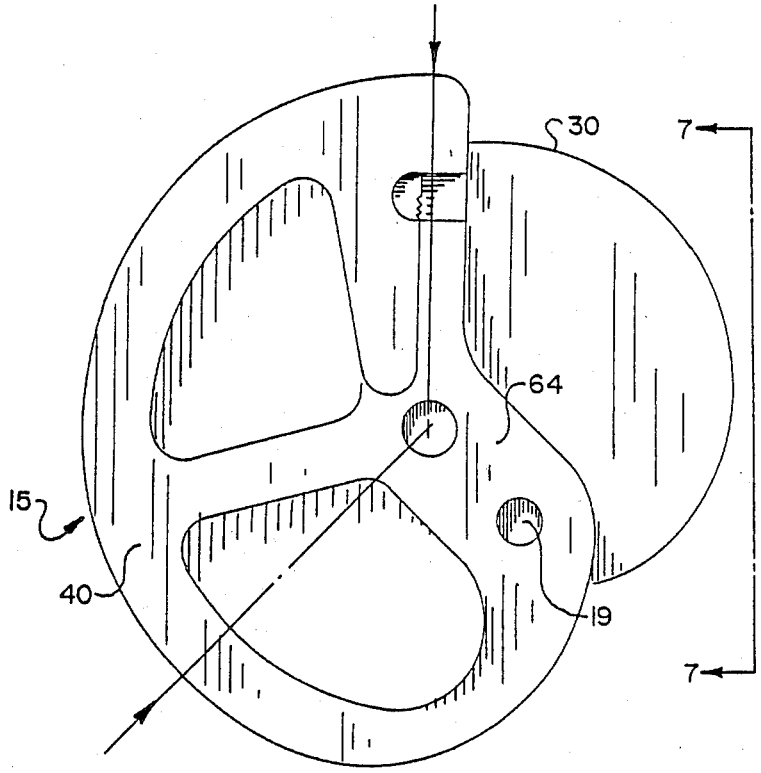
FIG. 4 is a view of the eccentric member of FIG. 1 from its opposite side; that is, rotated 180° around a vertical axis congruent with the plane of the paper.
Figure 6:
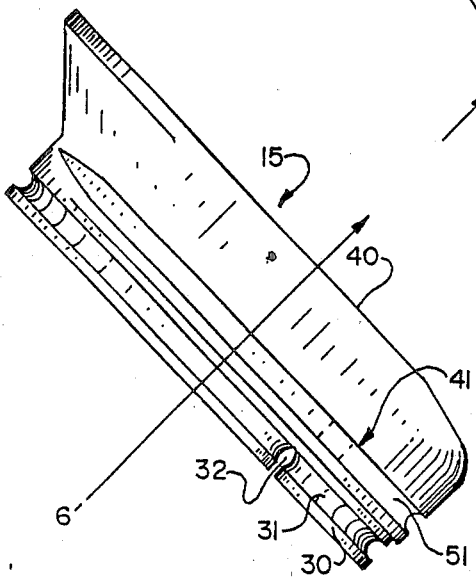
Figure 8:
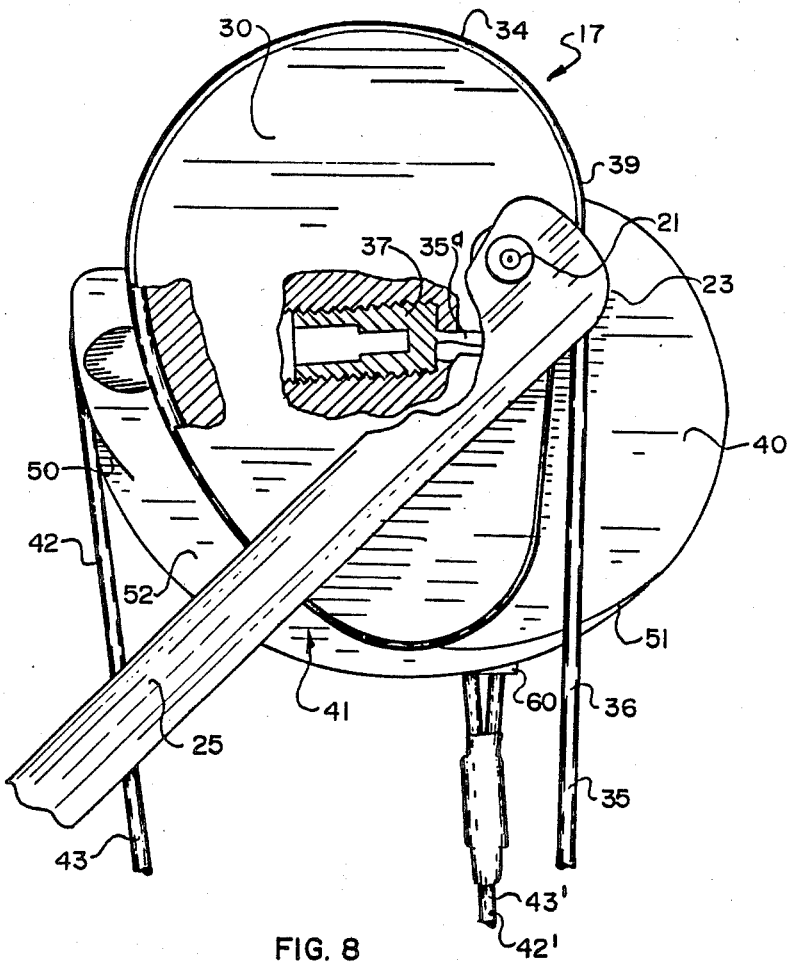
FIG. 8 is a view of an eccentric, the mirror image of that illustrated by FIG. 1, pivotally mounted on a bow limb together with a bowstring and associated tension stretches. The eccentric is shown partially in section to display certain components, and the eccentric, bowstring and tension stretches are shown with the bow in braced condition.
Figure 9:
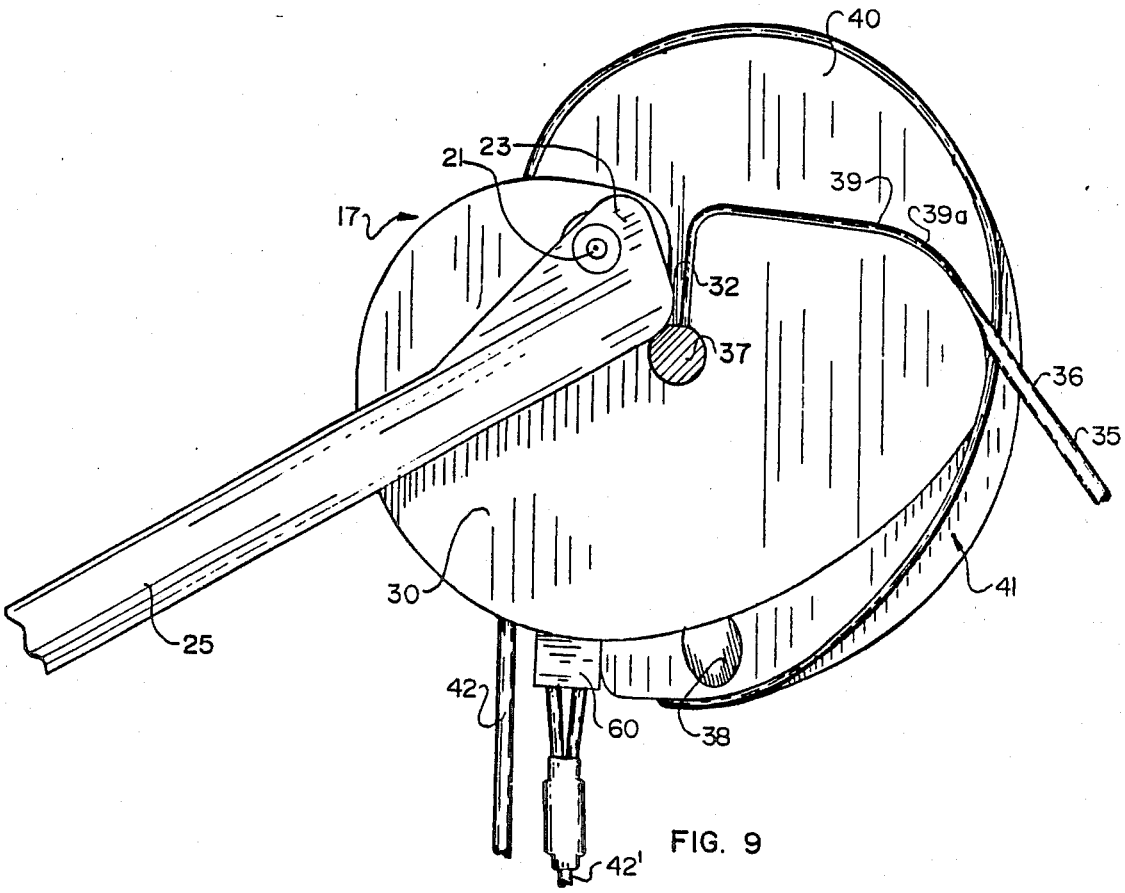
FIG. 9 is a view similar to FIG. 8 but with the bow in drawn condition so that the eccentric is rotated approximately 270° around its axis as compared to its position in FIG. 8.

Each eccentric 15, 17 has a first sheave portion 30 with a peripheral bowstring track in the form of a string groove 31 communicating with an anchoring slot 32. As best seen in FIGS. 8 and 9, a portion 34 of a bowstring 35 is wound around the sheave portion 30 in string groove 31, being held in place by the pressure of a large set screw 37 turned into a threaded bore 38 (FIGS. 1, 3 and 5) against the terminus of the anchor slot 32. Comparing FIGS. 8 and 9, it is apparent that as the string 35 is pulled toward the archer, the eccentric 17 pivots around axle 21 from braced condition (FIG. 8) to drawn condition (FIG. 9). As the eccentric 17 pivots, the wound portion 34 of the string 35 unwinds from the string groove 31 and pays out as a lengthening of the central stretch 36 of the bowstring 35. The central stretch is measured from the point of tangency 39 of the bowstring 35 with the string groove 31. The location of this point continuously migrates during pivoting of the eccentric from braced condition (FIG. 8) to its eventual location 39A at drawn condition (FIG. 9).

Figure 10:
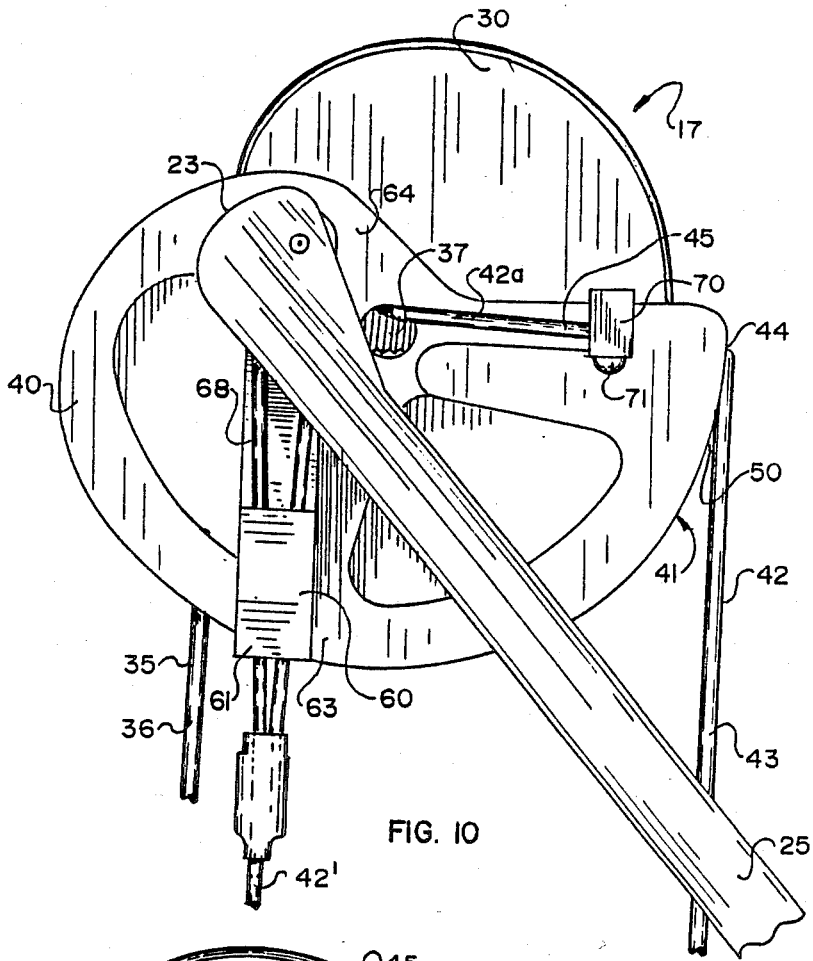
FIGS. 10 and 11 are views similar to FIGS. 8 and 9, respectively, from the opposite side of the bow limb.
Figure 11:
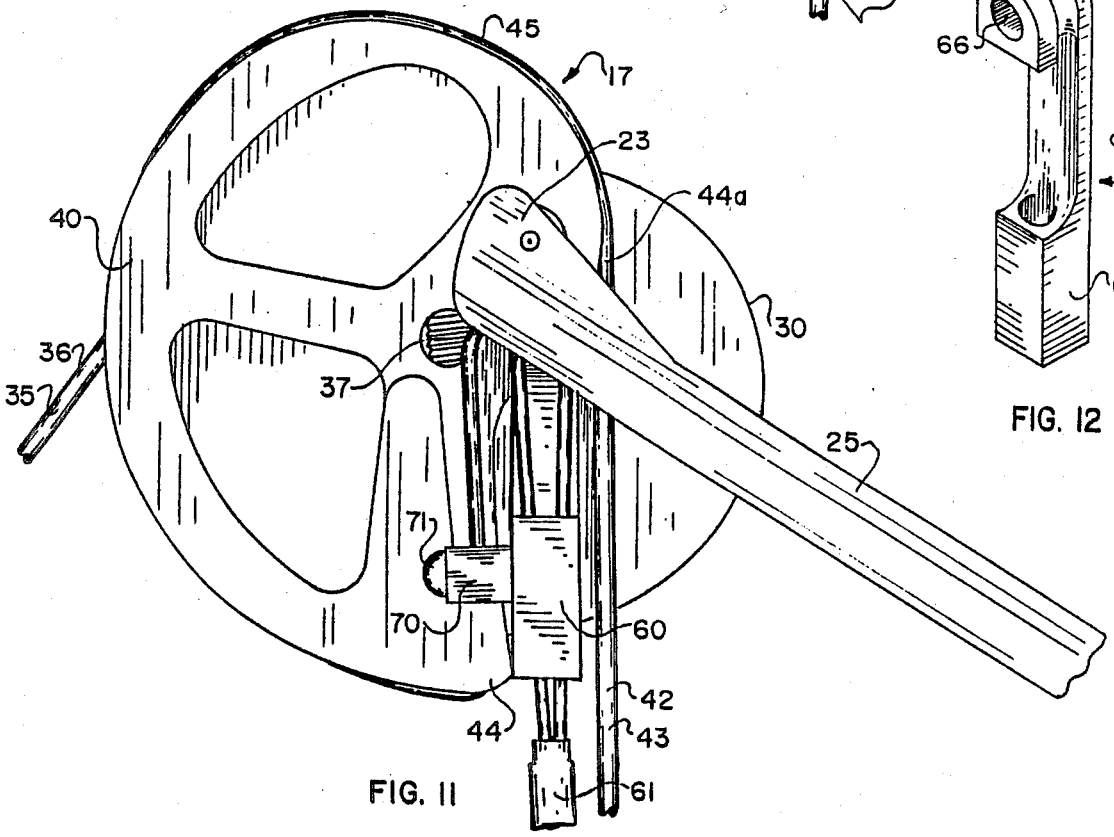

Each eccentric 15, 17 additionally includes a second sheave portion 40 with a specialized cable track, designated generally 41. The course of the tension run 42 associated with the eccentric 17 is best seen by reference to FIGS. 10 and 11, which may be regarded as showing the reverse sides of the apparatus shown by FIGS. 8 and 9, respectively. The tension run 42 begins at the anchoring point provided by the set screw 37, the termination 42A (FIG. 10) of the tension run 42 being immediately opposite the termination 35A (FIG. 8) of the bowstring 35 with respect to the set screw 37. In braced condition, as shown by FIG. 10, most of the tension run 42 is unwound and forms an end stretch 43 extending from a point of tangency 44 with the cable track 43 to a remote anchoring point, as will be explained in more detail. A relatively short portion 45 of the tension run 42 is stored in the cable track 41 between the point of tangency 44 and the anchor 37. FIG. 11 illustrates the eccentric 17 in drawn condition with the stored or wound portion 45 of the tension run 42 much lengthened, thereby reducing the length of the end stretch 43. The point of tangency 44A of the tension run 42 occurs approximately 270° of rotation removed from the original location 44, having migrated continuously around the cable track 41 from its initial position 44 as the eccentric was pivoted from its braced condition.

The mechanical advantage of the rigging comprising the eccentrics 15, 17, and cable loop comprising the bowstring 35 and tension runs 42, 42[1] is a function of, among other things, the cam ratio of the eccentrics. The cam ratio is determined by measuring the perpendicular distance between the axis of the axle 21 and the points of tangency 39 and 44. These perpendicular distances may be determined by direct measurement following well known analytical geometry methods. The cam ratio is defined as the "string distance" (21–39) divided by the "cable distance" (21–44). Thus, as illustrated, this ratio is initially less than unity at braced condition and progressively increases in value to greater than unity at drawn condition. The rate of change of the cam ratio and its value at any degree of rotation with respect to its braced position is "programmed" by the shapes of the string track 31 and cable track 41 and their orientations with respect to each other.

The string track, as illustrated, may be regarded as defining a plane of intersection through the string groove 31 which is approximately normal and transverse the axis of the axle 21. The cable track 41 includes a braced cable groove 50 of relatively large effective radius, a drawn cable groove 51 of relatively small effective radius, and a step-down, take-up cable ramp 52 connecting the two cable grooves 50, 51. The cable track of this invention thus functions to force the tension run 42 transversely over towards the middle of the limb 25 (thereby reducing the twisting moments which would otherwise be applied to the limbs), and down towards the axle 21 (thereby tending to increase the cam ratio of the eccentric near full drawn condition). In any event, the entire cable track 41 may be regarded as lying between parallel planes approximately parallel the plane of intersection of the string track 31.

The complete rigging of this invention, as best illustrated by FIG. 13, includes one eccentric configured as the eccentric 15 and one configured as the eccentric 17. These eccentrics 15, 17 are pivotally mounted at opposite limb tips 23 as shown by FIGS. 8 through 11 with respect to the "upper" eccentric 17. They are interconnected by the cable loop comprising the bowstring 35, which includes the central stretch 36, the tension run 42 associated with the eccentric 17 which includes end stretch 43, and a corresponding tension run 42' associated with the eccentric 15 which includes end stretch 43' shown anchored at its termination to the axle 21 by means of a shifter 60 (FIG. 12).

As the bowstring 35 is pulled, the limb tips 23 are displaced, thereby flexing the limbs 25 to store energy. At the same time, portions 44 of the tension runs 42 are wound onto the pivoting eccentrics 15, 17, commencing at the braced groove 50. As cable winds past the groove 50 to the ramp 52, the wound portion is urged down and transversely towards the smaller radius of drawn groove 51 by means of the ramp 52. Concurrently, the depending portion 61 of the shifter 60 (which in braced condition is held out away from the string groove 31 by camming surface 63), is permitted to move towards the string groove 31 as the recessed surface 64 is rotated into contact with the shifter 60. Accordingly, both tension runs 42, 42' are held away from the plane of the bowstring in braced condition of the bow (to permit vane clearance for a launched arrow), but both tension runs 42, 42' apply force very close to the plane of the string when the bow is in drawn condition. As shown, the shifter 60 includes an upper portion 65 with a bore 66 adapted to mount on the axle 21, thereby to function as a spacer for the eccentric 17. A cable groove 67 accommodates a corresponding loop 68 which is fashioned at the free end termination of the tension run 42'.

A resilient (e.g., rubber) bumper 70 is positioned in a channel 71 in the eccentric 17. The terminal portion 42A is movably positioned through a bore (not visible) in the bumper 70 to accommodate adjustments of the draw length and to hold the bumper 70 in position. Contact of the bumper 70 with the shifter 60, as best shown by FIG. 11, provides for a positive stop when the eccentric has pivoted to its designed full draw position. The draw length of the bow is achieved by backing off the set screw 37 so that the segment of the cable loop including the anchored ends 35A and 42A can be moved to lengthen or shorten the bowstring 35 as appropriate.

The principal advantage of the eccentric structure illustrated by the drawings is the opportunity it provides to program the cam ratio developed through a pivot cycle (as the bowstring is drawn and released to launch an arrow). The configuration of the string track and tension run track may be selected to produce a force-draw curve with a very rapid rate of pull force increase as a function of incremental draw at the initial stages of draw, followed by a prolonged, relatively constant pull force over the major portion of the draw of the bow, followed in turn by a rapid and substantial "let-off" or decrease in pulling force as the bowstring is pulled the last small increment to full draw.

FIG. 14 illustrates graphically the practical advantage of this invention. It is recognized that the actual force-draw curves of conventional compound bows with circular eccentrics are widely variable and are generally not as disciplined as would appear from FIG. 13. Nevertheless, the curve illustrated is representative. Assuming the eccentrics of the invention are substituted for the circular eccentrics of a prior art bow, and that the brace height and draw length are adjusted to be comparable to the prior art bow, it is possible to select configurations for the string track 31 and tension run track 41 to generate a force-draw curve with a similar percent let-off which stores considerably more available energy. The point B on FIG. 14 represents the distance at braced condition between a reference point at the handle 70 (FIG. 13) of the bow and the nocking point 71 of the bowstring. The point F represents the corresponding distance at full draw. The curves 72, 73 are plots of the pulling force (typically measured in pounds) required of an archer to hold the nocking point 71 at any draw distance (typically measured in inches) between the points B and F. It is generally understood by those skilled in the art that the area under the curves 72, 73 is an approximate representation (ignoring hysteresis losses) of the stored energy available for launching an arrow. The areas labeled G and H thus represent additional energy made available for this purpose by substituting the eccentrics of this invention for typical circular eccentrics of the prior art.

In contrast to typical eccentrics of the prior art, the string track 31 and tension run track 41 of this invention are nonparallel and noncentric. At least one, and preferably both, of the tracks 31 and 41 are noncircular. When both tracks 31 and 41 are noncircular, they are orienented so that their major diameters are nonparallel. In any event, the cam ratio of the eccentrics of this invention in operation increases more rapidly during the initial stages of draw of the bow string than does the cam ratio of a circular eccentric with parallel tracks corresponding to the string track 31 and tension run track 41.

Reference herein to certain details of the illustrated embodiment is not intended to limit the scope of the appended claims which in themselves recite those features of the invention regarded as significant.

We claim:

1. In an archery bow that includes resilient limbs which are deflected from their brace position to drawn position by the operation of a bowstring interconnected to the limbs through rigging including eccentric members which provide a varying cam ratio and tension runs opposite the bowstring with respect to the eccentrics, an improved rigging which comprises:

an eccentric member, with structure constituting means for providing pivotal connection of said eccentric about an axis, in operable association with a resilient limb, said eccentric member including:

a first, bowstring-engaging track with a plane of intersection transverse and approximately normal said axis constituting means for storing a portion of a bowstring when the bow limb is in its braced position and for paying out a portion of the bowstring as the bowstring is pulled to pivot the eccentric, thereby to deflect said limb, and a second, tension run-engaging track, including a braced groove of relatively large radius, a drawn groove of relatively small radius, and a ramp surface connecting said braced and drawn grooves so that as the bowstring is pulled from braced to drawn position, the tangent point of contact of said tension run with said eccentric migrates from said braced groove over towards said bowstring-engaging track to said drawn groove, constituting means for taking up and storing a portion of a tension run as said bowstring is pulled to pivot the eccentric, said first and second tracks being configured so that the cam ratio provided by said eccentric in operation increases more rapidly during the initial stage of draw than does the cam ratio in a circular eccentric with parallel tracks corresponding to said first and second tracks.

2. An improvement according to claim 1 wherein both the bowstring-engaging track and the tension run-engaging track are noncircular, and the major diameters of said tracks are nonparallel.

3. An improvement according to claim 1 including a shifter means operably associated with said eccentric and the terminal end of a second tension run to move said terminal end towards the plane of said bowstring at drawn position and away from the plane of said bowstring at braced position.

4. An improvement according to claim 3 wherein both the bowstring-engaging track and the tension run-engaging track are noncircular, and the major diameters of said tracks are nonparallel.

5. An improvement according to claim 4 including stop means operably associated with said eccentric to positively stop the pivoting rotation of said eccentric about said axis at full drawn position.

6. An improvement according to claim 5 wherein said stop means includes a bumper element carried by said eccentric.

7. An improvement according to claim 6 wherein said shifter means includes a stop surface arranged for contact by said bumper element at full drawn position.

8. An improvement according to claim 1 including stop means operably associated with said eccentric to positively stop the pivoting rotation of said eccentric about said axis at full drawn position.

9. An improvement according to claim 8 wherein said stop means includes a bumper element carried by said eccentric.

10. An improvement according to claim 9 including a shifter means operably associated with said eccentric and the terminal end of a second tension run to move said terminal end towards the plane of said bowstring at drawn position and away from the plane of said bowstring at braced position.

11. An improvement according to claim 10 wherein said shifter means includes a stop surface arranged for contact by said bumper element at full drawn position.

* * * * *